US006893108B2

(12) United States Patent
Choi et al.

(10) Patent No.: US 6,893,108 B2
(45) Date of Patent: May 17, 2005

(54) METHOD OF AND APPARATUS FOR DETERMINING AN AMOUNT OF INK USING CURRENT IN INK-JET PRINTER

(75) Inventors: Kyung-chool Choi, Gyeonggi-do (KR); Young-bok Jui, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 92 days.

(21) Appl. No.: 10/347,595

(22) Filed: Jan. 22, 2003

(65) Prior Publication Data

US 2003/0222934 A1 Dec. 4, 2003

(30) Foreign Application Priority Data

May 29, 2002 (KR) ..... 2002-29953

(51) Int. Cl.[7] ..... B41J 29/393
(52) U.S. Cl. ..... 347/19
(58) Field of Search ..... 347/19, 14, 23, 347/40, 6–7, 9

(56) References Cited

U.S. PATENT DOCUMENTS 6,039,428 A 3/2000 Juve
6,517,184 B1 * 2/2003 Bruch et al. ..... 347/23
6,663,207 B2 * 12/2003 Su et al. ..... 347/9
6,688,721 B1 * 2/2004 Serra ..... 347/19

FOREIGN PATENT DOCUMENTS

EP 593282 4/1994
EP 956964 11/1999

* cited by examiner

*Primary Examiner*—K. Feggins
(74) *Attorney, Agent, or Firm*—Staas & Halsey LLP

(57) ABSTRACT

A method of and apparatus for using current in an ink-jet printer having a head including a plurality of nozzles for each color and nozzle driving units driving the nozzles include detecting an amount of the current flowing through the head, dividing the detected amount of the current by a unit current and determining a result of the division as a first nozzle number, and accumulating first nozzle numbers and determining a result of the accumulation as a second nozzle number. A state of the ink-jet printer is determined using the second nozzle number, and the unit current corresponds to current flowing through a nozzle through which ink is ejected. The amount of the current flowing through the head can be detected, and the number of the nozzles, through which the ink has been ejected, can be precisely obtained using the detected amount of the current such that the amount of the ink in use, a remaining amount of the ink, or an ink deficiency degree for each color is precisely checked, and malfunction of the nozzles is recognized easily and quickly using the detected amount of the current.

28 Claims, 5 Drawing Sheets

METHOD OF AND APPARATUS FOR DETERMINING AN AMOUNT OF INK USING CURRENT IN INK-JET PRINTER

CROSS-REFERENCE TO RELATED APPLICATIONS

This application claims the benefit of Korean Patent Application No. 2002-29953, filed May 29, 2002, in the Korean Intellectual Property Office, the disclosure of which is incorporated herein by reference.

BACKGROUND OF THE INVENTION

1. Field of the Invention

The present invention relates to an ink-jet printer, and more particularly, to a method of and an apparatus for determining an amount of ink using current flowing through a head in an ink-jet printer.

2. Description of the Related Art

A conventional method of informing a user whether a remaining amount of ink used in an ink-jet printer is in short supply will be described below.

First, a controller (not shown) of the ink-jet printer performs a counting operation in response to a head fire pulse that is inputted to a head (not shown). Then, the controller determines whether the remaining amount of the ink is in short supply using a result of the counting operation. For example, when the ink is ejected through a nozzle in response to a "high" logic level of the head fire pulse, the controller performs the counting operation in response to the "high" logic level of the head fire pulse and determines whether the remaining amount of the ink is in short supply, using the result of the counting operation. In this case, the result of the counting operation is accumulated in a memory, and then, if a result of the accumulation reaches a predetermined value, it is warned (indicated) to a user that the ink is in short supply. Here, the predetermined value corresponds to the total number of operations in which ink is ejected through nozzles until the amount of the ink is in short supply.

Likewise, in the related art, it is measured how many times ink ejection through the nozzles is requested, instead of how many times the ink ejection through the nozzles is performed. Also, it is determined whether the ink is in short supply by comparing an accumulated value of the result of measurement (the accumulation) with the predetermined value. Hence, in the conventional method, since the ink may be not ejected through the requested nozzles, a user cannot be precisely informed whether the ink used in the ink-jet printer is in short supply.

Moreover, in the conventional method, it cannot be checked whether ink for each color is in short supply. That is, in the conventional method, it cannot be checked whether the ink for each color, such as cyan, magenta or yellow, is in short supply. It can be checked only whether color ink is in short supply or mono ink is in short supply.

SUMMARY OF THE INVENTION

To solve the above and/or other problems, it is an aspect of the present invention to provide a method of determining an amount of ink using current in an ink-jet printer, in which an amount of current flowing through a head of the ink-jet printer is detected, and a state of the inkjet printer, such as a state of ink for each color, is precisely checked using the detected amount of the current.

It is another aspect of the present invention to provide an apparatus for using current in an ink-jet printer by which a method of detecting a state of ink used in the ink-jet printer by using current flowing a head of the ink-jet printer is implemented.

Additional aspects and advantages of the invention will be set forth in part in the description which follows and, in part, will be obvious from the description, or may be learned by practice of the invention.

Accordingly, to achieve an aspect of the present invention, there is provided a method of using current in an ink-jet printer having a head including a plurality of nozzles for each color and nozzle driving units for driving the nozzles. The method includes detecting an amount of current flowing through the head, dividing the detected amount of the current by a unit current and determining a result of the division as a first nozzle number, and accumulating the first nozzle number and determining a result of the accumulation as a second nozzle number. A state of the ink-jet printer is determined using the second nozzle number, and the unit current corresponds to the current flowing through at least one nozzle through which ink is ejected.

In order to achieve another aspect of the present invention, there is provided an apparatus for using current in an ink-jet printer having a head including a plurality of nozzles for each color and nozzle driving units for driving the plurality of nozzles. The apparatus includes a current amount detecting unit which detects an amount of current flowing through the head and outputs the detected amount of the current, a nozzle number generating unit which divides the detected amount of the current that is inputted by the current amount detecting unit, by a unit current and outputs a result of the division as a first nozzle number, and an accumulation unit which accumulates first nozzle numbers that are inputted by the nozzle number generating unit and outputs a result of the accumulation as a second nozzle number. A state of the ink-jet printer is determined using the second nozzle number, and the unit current corresponds to the current flowing through at least one nozzle through which ink is ejected.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
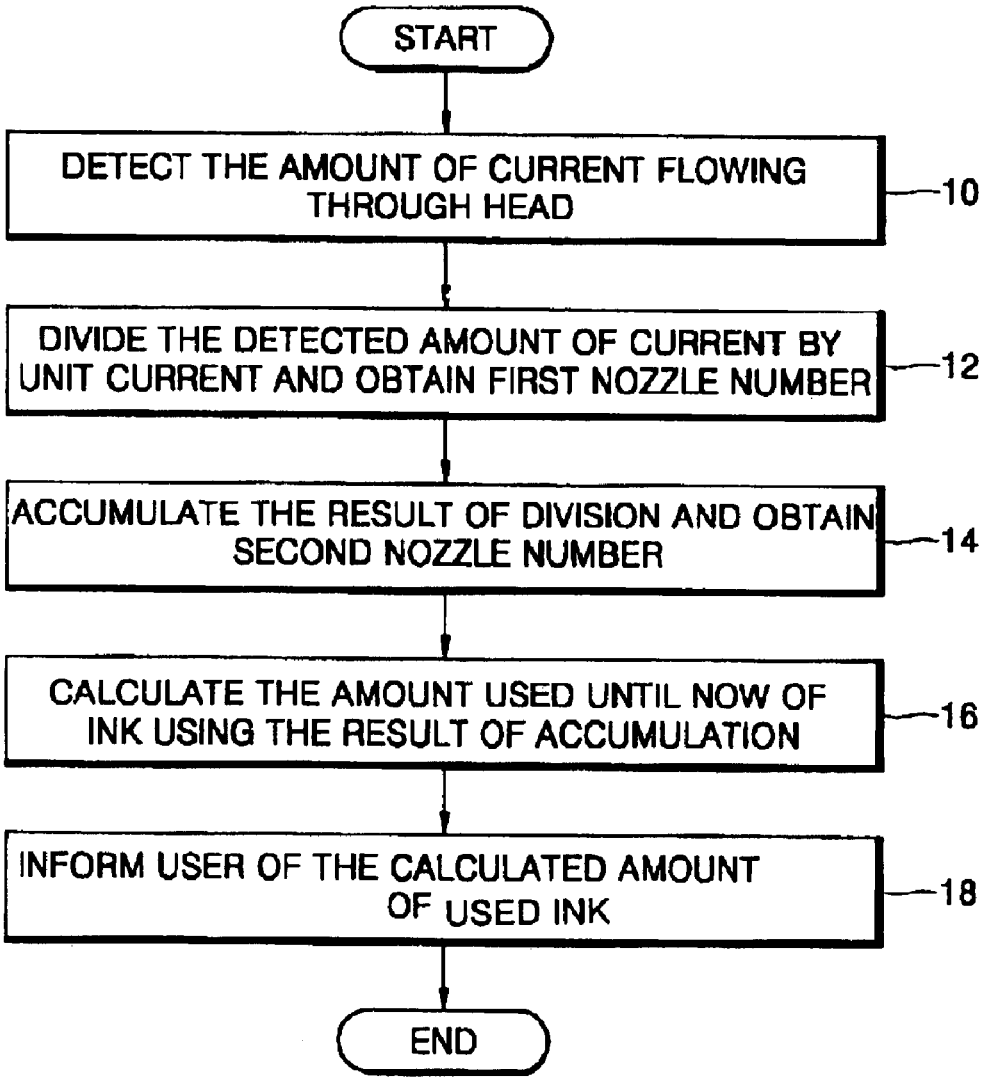
FIG. 1 is a flowchart illustrating a method of determining an amount of used ink using current in an ink-jet printer according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The present invention will be described more fully hereinafter with reference to the accompanying drawings in which preferred embodiments of the invention are shown.

FIG. 1 is a flowchart illustrating a method determining an amount of used ink using current in an ink-jet printer according to an embodiment of the present invention. The flowchart shown in FIG. 1 comprises obtaining first and second nozzle numbers by detecting an amount of current flowing through a head of the ink-jet printer (operations 10 through 14) and calculating an amount of used ink by using the second nozzle number and informing a user of the calculated amount of used ink (operations 16 and 18).

In operation 10, the amount of the current flowing through the head of the ink-jet printer is detected. Here, the head of the ink-jet printer includes a plurality of nozzles (not shown) for each color and nozzle driving units (not shown) for driving the nozzles. Here, each of the nozzle driving units is driven in response to a nozzle drive signal such that the current flows through a corresponding nozzle. When ink is ejected through each of the nozzles, a unit current flows through at least one nozzle. Here, nozzle drive signals correspond to conventional nozzle fire pulses of a conventional ink-jet printer.

In operation 12, after operation 10, the detected amount of the current flowing through the head is divided by the unit current, and the result of division is determined as a first nozzle number. Here, the first nozzle number corresponds to the number of nozzles through which ink is presently ejected.

In operation 14, after operation 12, first nozzle numbers are accumulated, and a result of the accumulation of the first nozzle numbers is determined as a second nozzle number. In this way, if each first nozzle number, which is the number of the nozzles through which ink is ejected in response to the nozzle drive signals during every ink ejection operation, is accumulated, the second nozzle number, which is a total number of the nozzles through which ink is ejected during all ink ejection operations until now, can be determined. In this case, a state of the ink-jet printer is determined using the second nozzle number.

Hereinafter, a method of using the current of the head of the ink-jet printer, in which the state of the ink-jet printer, i.e., the amount of the used ink (or a remaining amount or deficiency amount of ink), is determined using the second nozzle number, will be described.

As shown in FIG. 1, after operation 14, in operation 16, the amount of the ink used until now is calculated using the second nozzle number. For example, when the unit current is 0.3 A and the amount of the current detected in the head is 3 A, the first nozzle number is '10'. In this case, assuming that the second nozzle number corresponding to the result of the accumulation of the first nozzle numbers is '30', the total amount of the ink used until now of ink for all colors corresponds to 30 times of a unit amount of the ink ejected through at least one nozzle at one time. Unlike a conventional method of determining the amount of the used ink only from a result of counting the nozzle fire pulses, in the method of using the current in the ink-jet printer according to the present invention, the first nozzle number, which is the number of nozzles through which ink is substantially ejected, is first obtained using the current flowing through the nozzles driven in response to the nozzle drive pulses, and the amount of the used ink is determined using the second nozzle number corresponding to the accumulated first nozzle numbers. Thus, the amount of the used ink calculated by the method of using the current in the ink-jet printer according to the present invention is more precise than that of the conventional method.

If the second nozzle number for each color is obtained in operation 14, in operation 16, the amount of the used ink for each color can be calculated using the second nozzle number for each color. For example, assuming there are several nozzles in the head, and ink for each color, such as magenta, cyan, and yellow, or mono ink, is ejected through each of the nozzles, if the nozzle drive signals used for driving the nozzles are generated to drive only nozzles through which the magenta ink is ejected, the first nozzle number corresponds to the number of nozzles through which the magenta ink is presently ejected, and the second nozzle number corresponds to the total number of nozzles through which the magenta ink is ejected until now. Thus, an amount of the used magenta ink can be calculated using the second nozzle number.

Meanwhile, in the method of using the current in the ink-jet printer, in operation 18 following the operation 16, the calculated amount of the used ink is indicated to the user.

Figure 2:
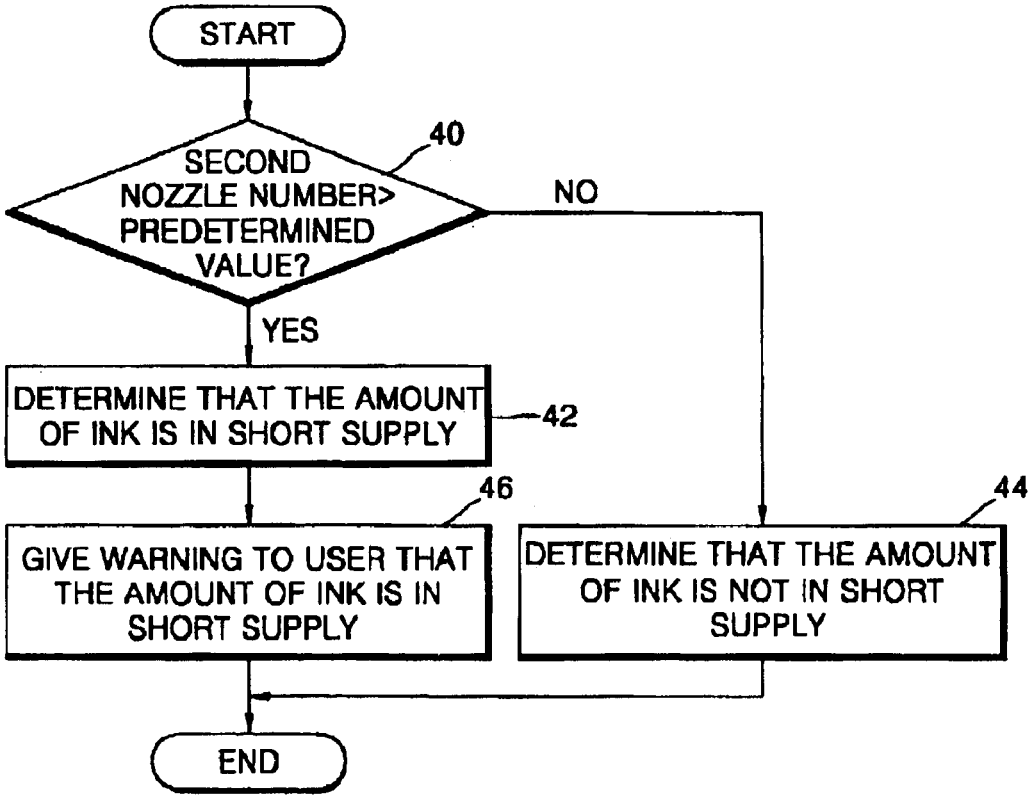
FIG. 2 is a flowchart illustrating a method of determining an amount of used ink using current in an ink-jet printer according to another embodiment of the present invention.

FIG. 2 is a flowchart illustrating another method of using the current in the ink-jet printer according to another embodiment of the present invention. The flowchart shown in FIG. 2 comprises determining an ink deficiency degree by using the second nozzle number (operations 40 through 46).

In operation 40 following the operation 14 of FIG. 1, it is determined whether the second nozzle number is greater than the predetermined value. Here, the predetermined value corresponds to the total number of the nozzles through which the ink is ejected until the ink is in short supply.

If it is determined that the second nozzle number is greater than the predetermined value, in operation 42, it is determined that the ink is in short supply. If it is determined that the second nozzle number is less than the predetermined value, in operation 44, it is determined that the ink is not in short supply.

In this case, if the second nozzle number for each color is obtained in operation 14, in operation 40, it is determined whether the second nozzle number for each color is greater than the predetermined value. In this case, it is determined for each color whether the ink for each color is in short supply (operations 42 and 44). That is, if it is determined that the second nozzle number for a first color, which is one of variety color, is greater than the predetermined value corresponding to the first color, in operation 42, it is determined that the ink corresponding to the first color is in short supply. However, if it is determined that the second nozzle number for the first color is not greater than the predetermined value corresponding to the first color, in operation 44, it is determined that the ink corresponding to the first color is not in short supply. For example, assuming the first color is cyan, and the predetermined value corresponding to the first color is one billion, if the accumulated second nozzle number corresponding to the accumulation number of the nozzles through which cyan ink is ejected is greater than one billion, it is determined that the cyan ink is in short supply.

According to the present invention, after operation 42, in operation 46, a warning is given to the user that the ink is in short supply. Thus, the user which receives the warning, may take a proper action like supplying new ink to an ink chamber of the ink-jet printer.

Here, according to the present invention, operations 16 and 18 shown in FIG. 1 may be performed while operations 40 through 46 shown in FIG. 2 are performed, or after operation 40 through 46 shown in FIG. 2 are performed.

Hereinafter, the method of using the current of the head in the ink-jet printer, in which the state of the inkjet printer, i.e., a malfunction of the nozzles in use, is determined by using the first nozzle number, will be described.

A malfunctioning nozzle of the head means an opened, shorted, or missing nozzle. Here, the opened nozzle means a nozzle through which ink is not ejected, among the nozzles that are driven in response to nozzle drive signals and requested to eject the ink. The shorted nozzle is a nozzle through which current more than the unit current flows when the ink is ejected. The missing nozzle is a nozzle through which ink is ejected, among nozzles that are not driven in response to the nozzle drive signal and requested not to eject ink.

Figure 3A:
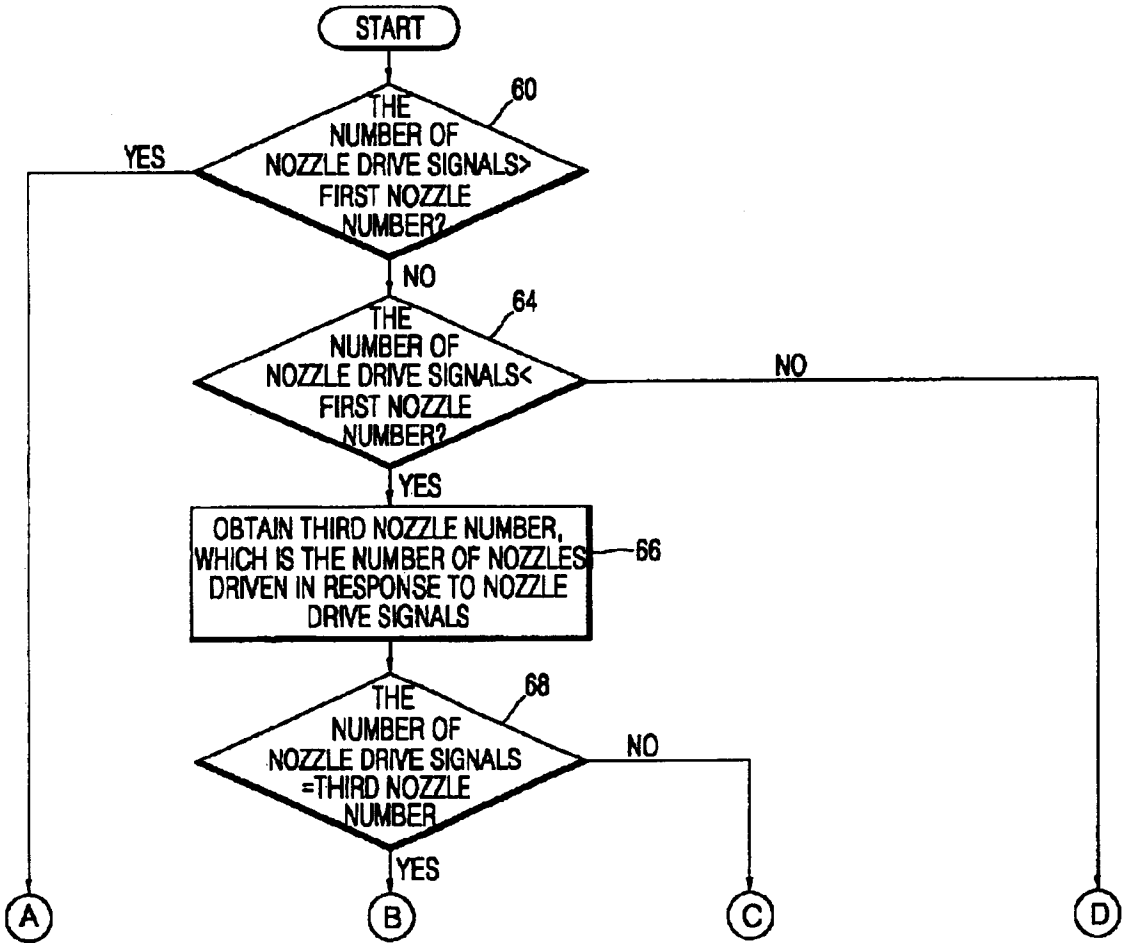
FIGS. 3A and 3B are flow charts illustrating a method of determining an amount of used ink using current in an ink-jet printer according to another embodiment of the present invention.
Figure 3B:
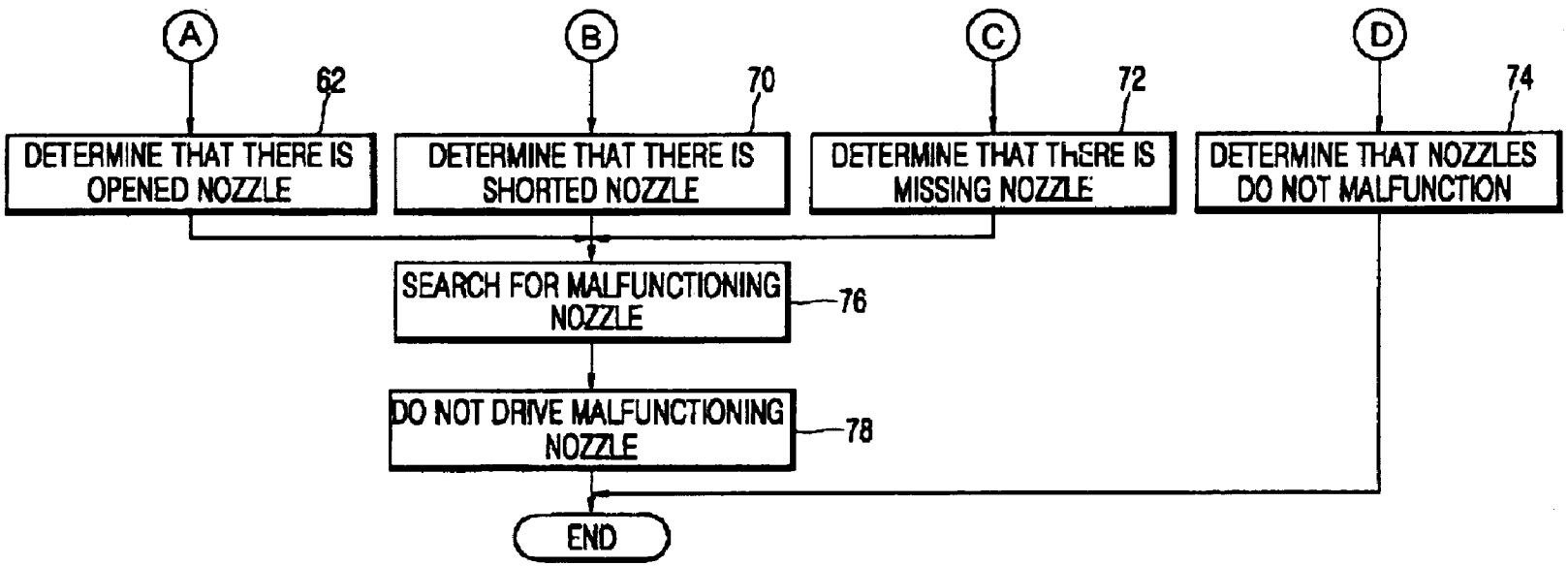

FIGS. 3A and 3B are flowcharts illustrating another method of using the current of the head in the ink-jet printer according to another embodiment of the present invention. The flowcharts shown in FIGS. 3A and 3B comprise determining the malfunction of the nozzles by comparing the number of nozzle drive signals with the first nozzle number (operations 60 through 78).

After operation 12, in operation 60, it is determined whether the number of the nozzle drive signals is greater than the first nozzle number. Here, the number of the nozzle drive signals means the number of the nozzles that are requested to eject ink.

If it is determined that the number of the nozzle drive signals is greater than the first nozzle number, in operation 62, it is determined that there is the opened nozzle in the head. This is because the ink is ejected through a number of the nozzles smaller than the number of the nozzles that are requested to eject the ink.

If it is determined that the number of the nozzle drive signals is not greater than the first nozzle number, in operation 64, it is determined that the number of the nozzle drive signals is smaller than the first nozzle number. If it is determined that the number of the nozzle drive signals is smaller than the first nozzle number, in operation 66, a third nozzle number, which is the actual number of nozzles driven in response to the nozzle drive signal, is obtained. Here, the third nozzle number corresponds to the number of nozzles which are being actually driven, rather than the number of the nozzles that are requested to drive. For this purpose, it is checked whether each of the nozzles that is requested to drive in response to the nozzle drive signals properly ejects the ink, i.e., whether each of the nozzles is normally driven.

After operation 66, in operation 68, it is determined whether the number of the nozzle drive signals is equal to the third nozzle number. If it is determined that the number of the nozzle drive signals is equal to the third nozzle number, in operation 70, it is determined that there is the shorted nozzle in the head. If the first nozzle number is greater than the number of the nozzle drive signals even though the nozzles as much as the nozzle drive signals are driven, it is determined to indicate that current greater than the unit current flows through a nozzle.

However, if it is determined that the number of the nozzle drive signals is not equal to the third nozzle number, in operation 72, it is determined that there is the missing nozzle. If the first nozzle number is greater than the number of the nozzle drive signals when the nozzles as much as the nozzle drive signals are not driven, it is determined to indicate that the nozzles that are not requested to drive are driven.

In this case, if it is determined that the number of the nozzle drive signals is equal to the first nozzle number, in operation 74, it is determined that the nozzles of the head do not malfunction.

After operation 62, 70, or 72, in operation 76, a malfunctioning nozzle, i.e., the opened, shorted, or missing nozzle, is searched. After operation 76, in operation 78, the opened, shorted, or missing nozzle is not driven any longer. This is because these nozzles may malfunction even when ejection is requested. After operation 78 or 74, in the method according to the present invention, information on the malfunction of the nozzles is transmitted to the user.

Hereinafter, a structure and an operation of an apparatus for using current in the inkjet printer according to another embodiment of the present invention will be further described.

Figure 4:
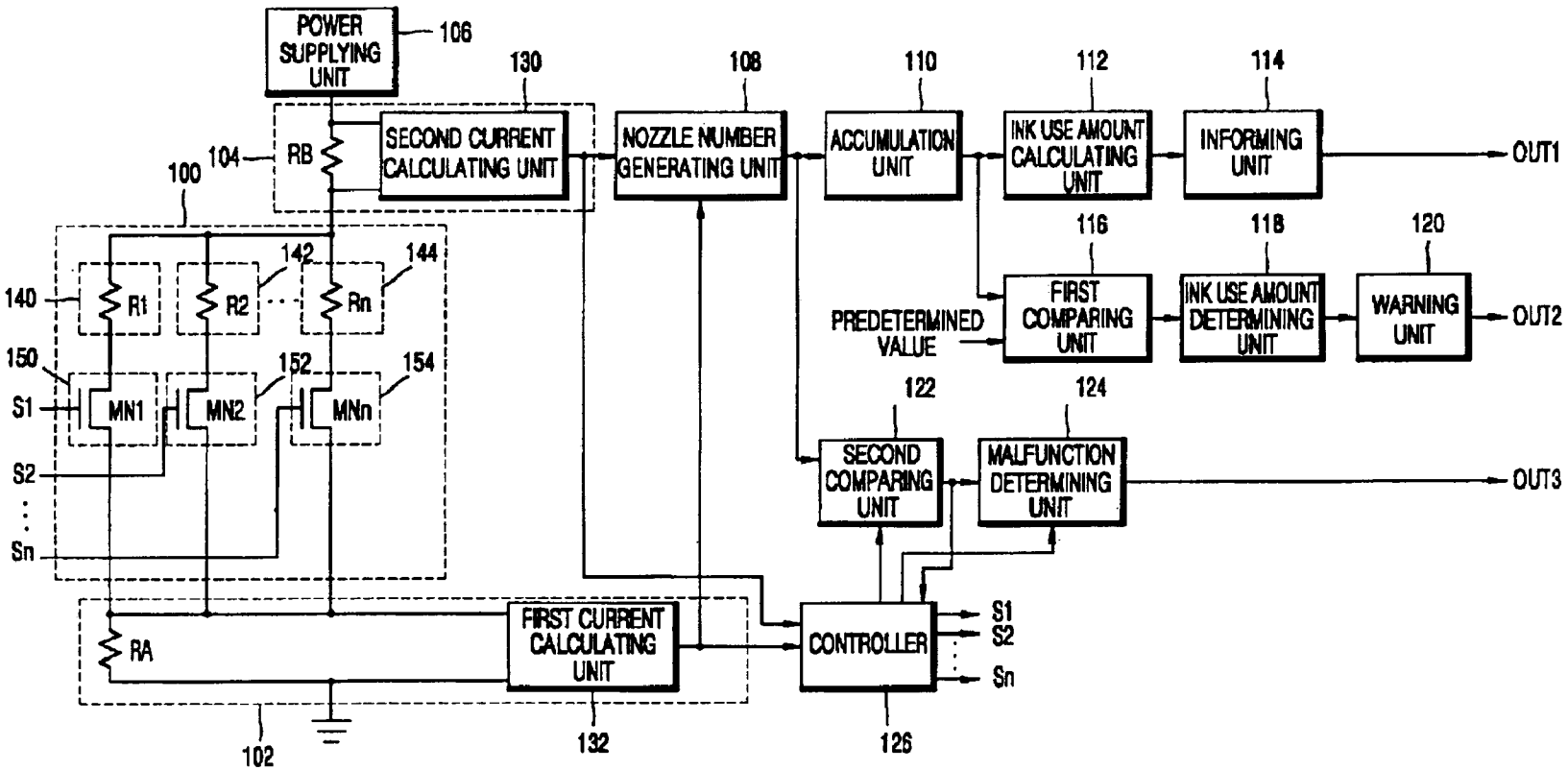
FIG. 4 is a block diagram of an apparatus for determining an amount of used ink using current in an ink-jet printer, in which the methods of FIGS. 1–3B are implemented, according to another embodiment of the present invention.

FIG. 4 is a block diagram of the apparatus for using the current in the ink-jet printer in which the methods shown in FIGS. 1–3B are implemented. The apparatus includes a head 100, a current amount detecting unit 102 or 104, a power supplying unit 106, a nozzle number generating unit 108, an accumulation unit 110, an ink use amount calculating unit 112, an informing unit 114, a first comparing unit 116, an ink amount determining unit 118, a warning unit 120, a second comparing unit 122, a malfunction determining unit 124, and a controller 126.

The head 100 shown in FIG. 4 includes a plurality of nozzles 140, 142, . . . , and 144 for each color, and nozzle driving units 150, 152, . . . , and 154 driving the nozzles 140, 142, . . . , and 144. For example, each of the nozzles 140, 142, . . . , or 144 is implemented with resistors R1, R2, . . . , or Rn, is heated by supplied current and then ejects ink. In this case, the nozzle driving unit 150, 152, . . . , or 154 determines to let current flow through the corresponding nozzle 140, 142, . . . , or 144 in response to a nozzle drive signal S1, S2, . . . , or Sn that is inputted by the controller 126. To do this, for example, each of the nozzle driving units 150, 152, . . . , and 154 may be implemented with respective MOS transistors. For example, as shown in FIG. 4, the nozzle driving unit 150, 152, . . . , or 154 may be implemented with an NMOS transistor MN1, MN2, . . . , or MNn that is turned on or off in response to the nozzle drive signal S1, S2, . . . or Sn. Thus, the current may be supplied to the nozzle 140, 142, . . . , or 144 that is connected to the nozzle driving unit 150, 152, . . . or 154 that is turned on in response to the nozzle drive signals S1, S2, . . . , and Sn.

The current amount detecting unit 102 or 104 which performs operation 10 shown in FIG. 1 detects the amount of the current flowing through the head 100 and outputs the detected amount of the current to the nozzle number generating unit 108. For this purpose, the current amount detecting unit 102 may be implemented with a resistor RA and a first current calculating unit 132. Here, the resistor RA is connected between the head 100 and a reference potential, i.e., ground. In this case, the first current calculating unit 132 divides a first voltage dropped between both ends of the resistor RA by a first value of the resistor RA and outputs a first result of the division of the first voltage as the detected current to the nozzle number generating unit 108. Alternatively, the current detecting unit 104 may be implemented with a resistor RB and a second current calculating unit 130. The resistor RB is connected between the head 100 and a supply power output from the power supplying unit 106. In this case, the second current calculating unit 130 divides a second voltage dropped between both ends of the resistor RB by a value of the resistor RB and outputs a second result of the division of the second voltage as the detected current to the nozzle number generating unit 108. For a better understanding of the current amount detecting unit 102 or 104, the current amount detecting units 102 and 104 are shown in FIG. 4. However, the apparatus for using the current in the ink-jet printer may include one of the current amount detecting units 102 and 104.

In order to perform operation 12 shown in FIG. 1, the nozzle number generating unit 108 divides the current which is inputted by the current amount detecting unit 102 or 104, by a predetermined unit current and outputs a result of the calculation (division) as the first nozzle number to the accumulation unit 110. In this case, in order to perform operation 14, the accumulation unit 110 accumulates the first nozzle number that is inputted by the nozzle number generating unit 108 and outputs to a result of the accumulation as the second nozzle number to the ink use amount calculating unit 112 and the first comparing unit 116, respectively.

In order to perform operation 16, the apparatus may further include an ink use amount calculating unit 112. Here, the ink use amount calculating ink 112 calculates the amount of the used ink used for ink ejection operation until now from the second nozzle number that is inputted by the accumulation unit 110, and outputs the calculated amount of the used ink to the informing unit 114. Alternatively, if the accumulation unit 110 generates the second nozzle number for each color, the ink use amount calculating unit 112 can calculate the amount of the used ink for each color from the second nozzle number that is accumulated for each color.

In order to perform operation 18, the informing unit 114 informs the user of the calculated amount of the used ink that is inputted by the ink use amount calculating unit 112 through an output terminal OUT1.

The first comparing unit 116 which performs operation 40 shown in FIG. 2 compares the second nozzle number that is inputted by the accumulation unit 110, with a predetermined value and outputs a result of the comparison as a first control signal to the ink amount determining unit 118.

In order to perform operations 42 and 44 shown in FIG. 2, the ink amount determining unit 118 determines whether the ink is in short supply, in response to the first control signal that is inputted by the first comparing unit 116, and outputs a result of the determination to the warning unit 120. That is, if it is recognized from the first control signal that the second nozzle number is greater than the predetermined value, the ink amount determining unit 118 determines that the ink is in short supply. Otherwise, the ink amount determining unit 118 determines that the ink is not in short supply. According to the present invention, the ink amount determining unit 118 may determine whether the ink for each color is in short supply. For this purpose, the accumulation unit 110 generates a plurality of second nozzle numbers corresponding to respective colors, and the first comparing unit 116 compares the second nozzle numbers for each color with predetermined values for each color and outputs results of the comparison for each color to the ink amount determining unit 118. In this case, the ink amount determining unit 118 determines whether the ink for each color is in short supply, from the results of the comparison for each color and outputs results of the determination for each color to the warning unit 120.

In order to perform operation 46 shown in FIG. 2, the warning unit 120 gives a warning to the user through an output terminal OUT2 information that the ink for each color is in short supply, in response to the results of the determination inputted by the ink amount determining unit 118.

Meanwhile, in order to perform operation 60 and 64 shown in FIG. 3, the second comparing unit 122 compares the number of the nozzle drive signals that are inputted by the controller 126 with the first nozzle number that is inputted by the nozzle number generating unit 108 and outputs a result of this comparison as a second control signal to the malfunction determining unit 124. For example, when the nozzle driving units 150, 152, . . . , and 154 are implemented as shown in FIG. 4, the number of the nozzle drive signals indicates the number of the nozzle drive signals having a "high" logic level.

The malfunction determining unit 124 which performs operations 62, 70, 72, and 74 determines the malfunction of the nozzles in response to the second control signal inputted by the second comparing unit 122 and outputs a result of this determination to an output terminal OUT3. For example, if it is recognized from the second control signal inputted by the second comparing unit 122 that the number of the nozzle drive signals is greater than the first nozzle number, the malfunction determining unit 124 determines that there is the opened nozzle. However, if it is recognized from the second control signal that the number of the nozzle drive signals is equal to the first nozzle number, the malfunction determining unit 124 determines that the nozzles do not malfunction. Also, if it is recognized from the second control signal that the number of the nozzle drive signals is smaller than the first nozzle number, the malfunction determining unit 124 determines that there is the shorted or missing nozzle.

In order to perform operations 66 and 68 shown in FIG. 3A, the controller 126 sequentially applies each of the nozzle drive signals to the corresponding respective nozzles one by one in response to the second control signal inputted by the second comparing unit 122. For example, the controller 126 sequentially applies the nozzle drive signals to the nozzles one by one when it is recognized from the second control signal inputted by the second comparing unit 122 that the number of the nozzle drive signals is smaller than the first nozzle number. In this case, the controller 126 checks from an output of the current amount detecting unit 102 or 104 whether the nozzles to which the nozzle drive signals are applied, are driven in response to the applied nozzle drive signals. In this way, the controller 126 calculates the third nozzle number by checking the nozzles corresponding to the number of the nozzle drive signals one by one, and then compares the third nozzle number with the number of the nozzle drive signals and outputs a result of this comparison as a third control signal to the malfunction determining unit 124.

For example, the controller 126 generates only the nozzle drive signal S1 of the nozzle drive signals S1, S2, . . . , and Sn with the "high" logic level and checks whether the nozzle 140 is driven, by checking whether current flowing through the nozzle 140 is the unit current. The controller 126 can check in this way whether all other nozzles are properly driven. In this case, the malfunction determining unit 124 which performs operations 70 and 72 shown in FIG. 3B determines whether the nozzles malfunction, in response to the second control signal inputted by the second comparing unit 122 and the third control signal inputted by the controller 126.

For example, the malfunction determining unit 124 determines that there is the opened nozzle if it is recognized from the second control signal inputted by the second comparing unit 122 that the number of the nozzle drive signals is greater than the first nozzle number. However, when it is recognized from the second control signal that the number of the nozzle drive signals is not greater than the first nozzle number, the malfunction determining unit 124 determines that there is the shorted nozzle if it is recognized from the third control signal inputted by the controller 126 that the number of the nozzle drive signals is the third nozzle number. If it is recognized from the third control signal that the number of the nozzle drive signals is not the third nozzle number, the malfunction determining unit 124 determines that there is the missing nozzle.

According to the present invention, the apparatus for using the current in the inkjet printer may include a memory (not shown) in which existence of the malfunction and/or a type of the malfunction determined by the malfunction determining unit 124 is accumulated, and/or an informing unit (not shown) which informs a user of the existence of the malfunction and/or the type of the malfunction.

Each unit of the apparatus for using the current in the ink-jet printer according to the present invention shown in FIG. 4 may be selectively provided according to the methods shown in FIGS. 1 through 3B. For example, if the apparatus shown in FIG. 4 performs only the method shown in FIG. 1, the apparatus may not include the first and second comparing units 116 and 122, the ink amount determining unit 118, the warning unit 120, and the malfunction determining unit 124. If the apparatus shown in FIG. 4 performs only the method shown in FIG. 2, the apparatus may not include the ink use amount calculating unit 112, the informing unit 114, the second comparing unit 122, and the malfunction determining unit 124.

As described above, the method of and the apparatus for using the current in the inkjet printer according to the present invention can detect the amount of the current flowing through the head of the ink-jet printer and can precisely obtain the number of the nozzles, through which the ink has been ejected, using the detected amount of the current. Such as the amount of the used ink, the remaining amount of the ink, or an ink deficiency degree for each color is precisely checked, and any malfunction of the nozzles is recognized easily and quickly using the detected amount of the current.

While this invention has been particularly shown and described with reference to preferred embodiments thereof, it will be understood by those skilled in the art that various changes in form and details may be made therein without departing from the spirit and scope of the invention as defined by the appended claims and equivalents thereof.

What is claimed is:

1. A method of using current in an ink-jet printer having a head including a plurality of nozzles for each color and nozzle driving units driving the nozzles in response to nozzle drive signals, the method comprising:

detecting an amount of the current flowing through the head;

dividing the detected amount of the current by a unit current and determining a result of the division as a first nozzle number; and accumulating the first nozzle number and determining a result of the accumulation as a second nozzle number;

wherein a state of the ink-jet printer is determined using the second nozzle number, and the unit current corresponds to current flowing through a nozzle which ink is ejected.

2. The method of claim 1, further comprising:

calculating an amount of used ink which has been ejected through the nozzles, by using the second nozzle number.

3. The method of claim 2, wherein the calculating of the amount of the used ink comprises:

obtaining the second nozzle number for each color; and calculating the amount of ink used for each color by using the second nozzle number that is accumulated for each color.

4. The method of claim 2, further comprising:

informing a user of the calculated amount of the used ink.

5. The method of claim 1, further comprising:

determining whether the second nozzle number is greater than a reference value;

determining that the ink is in short supply if the second nozzle number is greater than the predetermined value; and determining that the ink is not in short supply if the second nozzle number is less than or equal to the reference value;

wherein the reference value corresponds to a total number of operations in which ink is ejected through nozzles until the ink is in short supply.

6. The method of claim 5, wherein the calculating of the amount of the used ink comprises:

obtaining the second nozzle number for each color;

determining whether the second nozzle number for each color is greater than the reference value for each color; and determining whether the ink for each color is in short supply.

7. The method of claim 6, further comprising:

calculating the amount of ink used until now by using the second nozzle number.

8. The method of claim 7, further comprising informing a user of the calculated amount of the used ink.

9. The method of claim 5, further comprising:

generating a warning to a user that the ink is in short supply.

10. The method of claim 9, further comprising:

searching for the opened, shorted, or missing nozzle; and preventing the searched opened, shorted, or missing nozzle from being driven.

11. The method of claim 1, further comprising:

determining whether the number of the nozzle drive signals that are used to drive the nozzles is greater than the first nozzle number;

determining that there is an opened nozzle in response to a determination that the number of the nozzle drive signals is greater than the first nozzle number;

determining whether the number of the nozzle drive signals is smaller than the first nozzle number in response to a determination that the number of the nozzle drive signals is not greater than the first nozzle number;

obtaining a third nozzle number, which is the number of nozzles driven in response to the nozzle drive signals, in response to a determination that the number of the nozzle drive signals is smaller than the first nozzle number;

determining whether the number of the nozzle drive signals is equal to the third nozzle number;

determining that there is a shorted nozzle in response to a determination that the number of the nozzle drive signals is equal to the third nozzle number;

determining that there is a missing nozzle in response to a determination that the number of the nozzle drive signals is not equal to the third nozzle number; and determining that the nozzles of the head do not malfunction in response to a determination that the number of the nozzle drive signals is equal to the first nozzle number.

12. An apparatus for using current in an ink-jet printer having a head including a plurality of nozzles for each color and nozzle driving units driving the nozzles in response to nozzle drive signals, the apparatus comprising:

a current amount detecting unit which detects an amount of the current flowing through the head and outputs the detected amount of the current;

a nozzle number generating unit which divides the detected amount of the current that is inputted by the current amount detecting unit by a unit current and outputs a first nozzle number; and an accumulation unit which accumulates first nozzle numbers that are inputted by the nozzle number generating unit and outputs a second nozzle number;

wherein a state of the ink-jet printer is determined using the second nozzle number, and the unit current corresponds to current flowing through one of the nozzles through which ink is ejected.

13. The apparatus of claim 12, wherein the current amount detecting unit comprises:

a resistor which is connected between the head and a reference broader potential; and a first current calculating unit which divides a voltage dropped between both ends of the resistor by a value of the resistor and outputs the detected amount of current.

14. The apparatus of claim 12, wherein the current amount detecting unit comprises:

a resistor which is connected between the head and a supply power; and a second current calculating unit which divides a voltage dropped between both ends of the resistor by a value of the resistor and outputs the detected amount of current.

15. The apparatus of claim 12, further comprising an ink use amount calculating unit which calculates the amount of the ink used until now from the second nozzle number that is inputted by the accumulation unit and outputs the calculated amount of the used ink.

16. The apparatus of claim 15, wherein the accumulation unit generates the second nozzle number for each color, and the ink use amount calculating unit calculates the amount of the used ink for each color from the second nozzle number that is accumulated for each color.

17. The apparatus of claim 15, further comprising:

an informing unit which informs a user of the calculated amount of the used ink inputted by the ink use amount calculating unit.

18. The apparatus of claim 12, further comprising:

a first comparing unit which compares the second nozzle number that is inputted by the accumulation unit, with a reference value and outputs a first control signal; and an ink amount determining unit which determines whether the ink is in short supply, and outputs a result of the determination in response to the first control signal;

wherein the reference value corresponds to a total number of operations in which the ink is ejected through the nozzles until the ink is in short supply.

19. The apparatus of claim 18, wherein the accumulation unit generates the second nozzle number for each color, the first comparing unit compares the second nozzle number that is accumulated for each color with the reference value for each color, and the ink amount determining unit determines whether the ink for each color is in short supply.

20. The apparatus of claim 18, further comprising:

a warning unit which outputs a warning to a user that the ink is in short supply, in response to the result of the determination inputted by the ink amount determining unit.

21. The apparatus of claim 12, further comprising:

a second comparing unit which compares the number of the nozzle drive signals that are used to drive the nozzles, with the first nozzle number and outputs a second control signal;

a malfunction determining unit which determines whether the nozzles malfunction, and outputs a result of the determination, in response to the second control signal; and a controller which generates the nozzle drive signals and outputs the number of the nozzle drive signals.

22. The apparatus of claim 21, wherein the controller sequentially applies each of the nozzle drive signals to the corresponding respective nozzles one by one in response to the second control signal, checks whether the nozzles to which the nozzle drive signals are applied, are driven in response to the applied nozzle drive signals from an output of the current amount detecting unit to generate a third nozzle number corresponding to a result of checking, and then compares the third nozzle number with the number of the nozzle drive signals and outputs a third control signal, and the malfunction determining unit determines whether the nozzles malfunction in response to the second and third control signals.

23. An apparatus for using current in an ink-jet printer having a head including a plurality of nozzles for each color and nozzle driving units driving the nozzles in response to nozzle drive signals, the apparatus comprising:

a current amount detecting unit which detects an amount of the current flowing through the head in response to the nozzle drive signals and outputs the detected amount of the current; and a nozzle number generating unit which divides the detected amount of the current that is inputted by the current amount detecting unit by a unit current and outputs a first nozzle number representing a state of the nozzles of the head.

24. The apparatus of claim 23, further comprising:

a comparing unit comparing the number of the nozzle drive signals with the first nozzle number and outputting a control signal representing that one of the nozzles malfunctions.

25. The apparatus of claim 23, further comprising:

an accumulation unit which accumulates first nozzle numbers that are inputted by the nozzle number generating unit and outputs a second nozzle number representing a second state of the nozzles of the head.

26. An apparatus for using current in an inkjet printer having a head including a plurality of nozzles for each color and nozzle driving units driving the nozzles in response to nozzle drive signals, the apparatus comprising:

a current amount detecting unit which detects an amount of the current flowing through the head in response to the nozzle drive signals and outputs the detected amount of the current;

a nozzle number generating unit which divides the detected amount of the current that is inputted by the current amount detecting unit by a unit current and outputs a first nozzle number;

an accumulation unit which accumulates first nozzle numbers that are inputted by the nozzle number generating unit and outputs a second nozzle number; and a comparing unit comparing the second nozzle number with a reference value and outputting a control signal representing a state of the nozzles of the head.

27. A method of using current in an ink-jet printer having a head including a plurality of nozzles for each color and nozzle driving units driving the nozzles in response to nozzle drive signals, the method comprising:

detecting an amount of the current flowing through the head in response to the nozzle drive signals to output the detected amount of the current; and dividing the detected amount of the current by a unit current to output a first nozzle number representing a state of the nozzles of the head representing a malfunction state of the nozzles of the head.

28. A method of using current in an ink-jet printer having a head including a plurality of nozzles for each color and nozzle driving units driving the nozzles in response to nozzle drive signals, the method comprising:

detecting an amount of the current flowing through the head in response to the nozzle drive signals to output the detected amount of the current;

dividing the detected amount of the current that is inputted by the current amount detecting unit by a unit current to output a first nozzle number;

accumulating first nozzle numbers to output a second nozzle number; and comparing the second nozzle number with a reference value to output a control signal representing a state of the nozzles of the head.

* * * * *

UNITED STATES PATENT AND TRADEMARK OFFICE

CERTIFICATE OF CORRECTION

PATENT NO. : 6,893,108 B2
DATED : May 17, 2005
INVENTOR(S) : Kyung-chool Choi et al.

It is certified that error appears in the above-identified patent and that said Letters Patent is hereby corrected as shown below:

Title page,
Item [75], Inventors, change "Young-bok Jui" to -- Young-bok Ju --.

Signed and Sealed this

Seventh Day of March, 2006

JON W. DUDAS
*Director of the United States Patent and Trademark Office*